US009188117B2

(12) United States Patent
Ito et al.

(10) Patent No.: US 9,188,117 B2
(45) Date of Patent: Nov. 17, 2015

(54) VALVE DEVICE FOR COMPRESSOR

(75) Inventors: Takahiro Ito, Isesaki (JP); Yoshie Matsuzaki, Isesaki (JP)

(73) Assignee: SANDEN CORPORATION, Gunma (JP)

( * ) Notice: Subject to any disclaimer, the term of this patent is extended or adjusted under 35 U.S.C. 154(b) by 40 days.

(21) Appl. No.: 14/004,054

(22) PCT Filed: Feb. 10, 2012

(86) PCT No.: PCT/JP2012/053042

§ 371 (c)(1),
(2), (4) Date: Sep. 9, 2013

(87) PCT Pub. No.: WO2012/120964

PCT Pub. Date: Sep. 13, 2012

(65) Prior Publication Data

US 2013/0340870 A1 Dec. 26, 2013

(30) Foreign Application Priority Data

Mar. 8, 2011 (JP) ..... 2011-050717

(51) Int. Cl.

| | |
|---|---|
| ***F16K 15/16*** | (2006.01) |
| ***F16K 15/00*** | (2006.01) |
| ***F16K 17/00*** | (2006.01) |
| ***F16K 21/04*** | (2006.01) |
| ***F04B 39/10*** | (2006.01) |
| ***F04B 53/10*** | (2006.01) |

(52) U.S. Cl.

CPC ..... *F04B 39/1086* (2013.01); *F04B 39/10* (2013.01); *F04B 39/1073* (2013.01); *F04B 53/105* (2013.01); *F04B 53/1087* (2013.01); *Y10T 137/7891* (2015.04)

(58) Field of Classification Search

CPC .. F04B 39/1073; F04B 39/1066; F04B 39/10; F04B 53/105; F04B 53/1087; F04B 39/108; F16K 15/14; F16K 15/144; F16K 15/16; F04C 29/128

USPC ..... 137/512.1, 512.15, 512.4, 527, 137/854–858, 843, 852; 251/332, 333, 334, 251/359

See application file for complete search history.

(56) References Cited

U.S. PATENT DOCUMENTS 2,626,776 A * 1/1953 Martineau ..... 251/359
5,380,176 A * 1/1995 Kikuchi et al. ..... 418/55.1

(Continued)

FOREIGN PATENT DOCUMENTS

CN 101201049 6/2008
JP 2-040185 2/1990

(Continued)

OTHER PUBLICATIONS

Search Report dated Dec. 3, 2014 issued in the corresponding European Patent Application No. 12 75 5625.6.

(Continued)

*Primary Examiner* — John K Fristoe, Jr.
*Assistant Examiner* — Hailey K Do
(74) *Attorney, Agent, or Firm* — Cozen O'Connor

(57) ABSTRACT

A valve device for a compressor is improved to suppress noise and a decrease in compressor efficiency caused by pressure pulsations, and also to prevent degradation in compressor performance by ensuring durability. In a valve device of a reed valve structure including: a valve hole 103*a* or 103*b* formed in a valve plate 103; a valve seat 103*e* formed in an outer peripheral portion of the valve hole so as to protrude in a boss shape to a groove 103*f* formed around an outside thereof; and a valve body 151 having a proximal end 151A connected to the valve plate and a distal end 151B allowed to freely come into and out of contact with a seat surface of the valve seat, a plurality of ribs 103*g* extend radially from a peripheral wall of the valve seat to an outer peripheral wall of the groove.

5 Claims, 10 Drawing Sheets

(56) References Cited

U.S. PATENT DOCUMENTS

| | | | | |
|---|---|---|---|---|
| 5,884,665 | A * | 3/1999 | Thurston et al. | 137/856 |
| 6,099,275 | A * | 8/2000 | Fraser et al. | 417/569 |
| 6,254,057 | B1 * | 7/2001 | Pubben et al. | 251/45 |
| 6,309,194 | B1 * | 10/2001 | Fraser et al. | 417/569 |
| 6,565,336 | B1 * | 5/2003 | Fraser et al. | 417/569 |
| 7,364,413 | B2 * | 4/2008 | Nieter | 417/567 |
| 2009/0081060 | A1 | 3/2009 | Takai | |
| 2013/0014841 | A1 | 1/2013 | Moroi et al. | |

FOREIGN PATENT DOCUMENTS

| | | | |
|---|---|---|---|
| JP | 2-81973 | | 3/1990 |
| JP | 4-1682 | | 1/1992 |
| JP | 11-210626 | | 8/1999 |
| JP | 2001-082337 | | 3/2001 |
| JP | 2001-82337 | | 3/2001 |
| JP | 2002-070768 | | 3/2002 |
| JP | 2002-70768 | | 3/2002 |
| JP | 2008-2370 | | 1/2008 |
| JP | 2008-02370 | | 1/2008 |
| JP | 2009-108687 | | 5/2009 |
| JP | 2011-226464 | | 11/2011 |
| WO | WO 2007018002 | A1 * | 2/2007 |

OTHER PUBLICATIONS

Korean Patent Office Communication (and a partial English translation thereof) dated Aug. 20, 2014 issued in the corresponding Korean Patent Application No. 10-2013-7025741.

* cited by examiner

ECCENTRIC COMPRESSION LOAD

VALVE BODY APPLIES COMPRESSION LOAD
TO VALVE SEAT TO CAUSE BENDING MOMENT

WHEN BUCKLING LOAD IS REACHED, DISTORTION
INCREASES AND RESULTS IN BREAKING EVEN WHEN
COMPRESSION STRENGTH IS NOT EXCEEDED, OR
REPEATED COMPRESSION CAUSES FATIGUE BREAKING

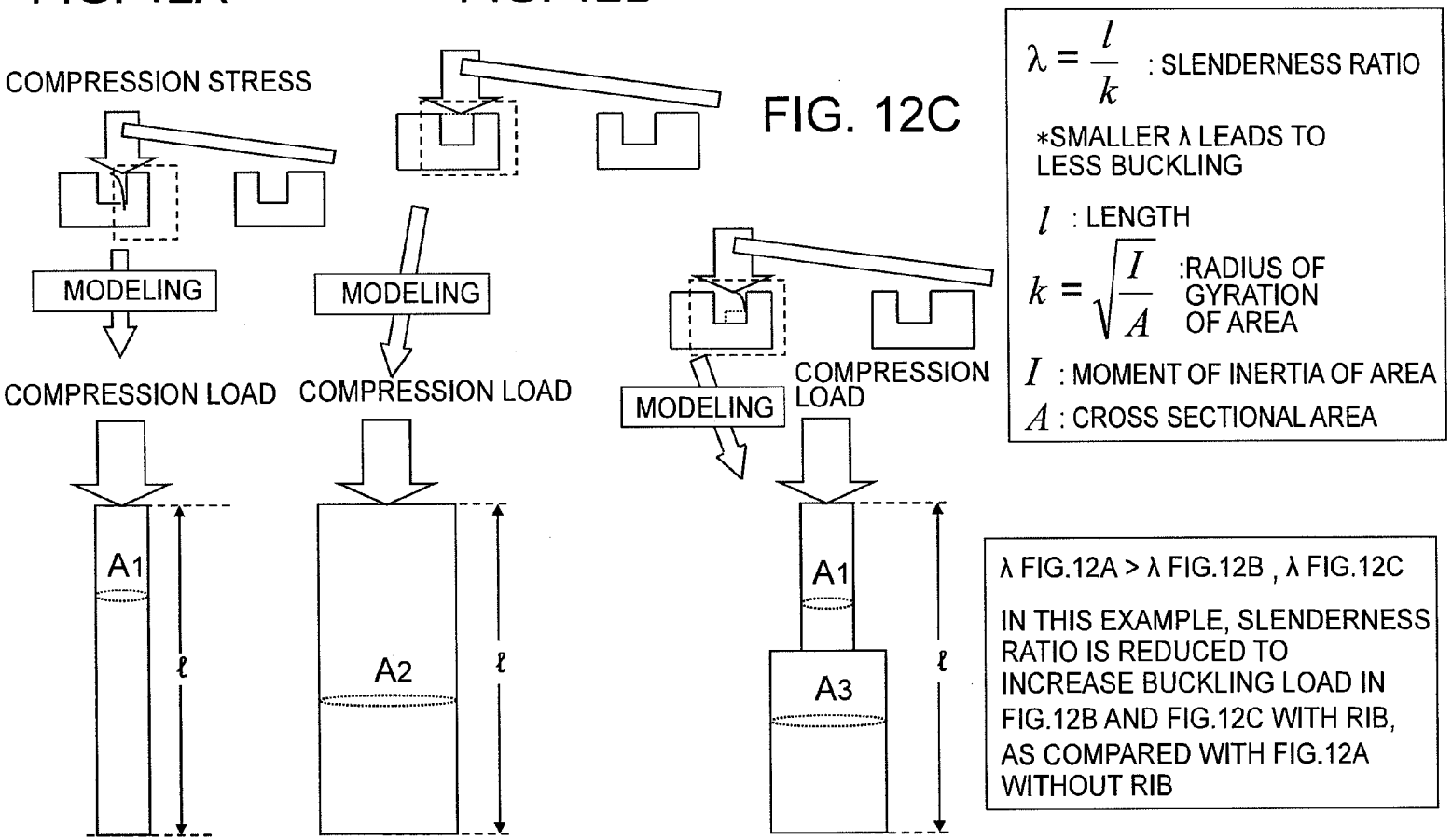
FIG. 12A
COMPRESSION STRESS
MODELING
COMPRESSION LOAD
A1
ℓ
FIG. 12B
MODELING
COMPRESSION LOAD
A2
ℓ
FIG. 12C
MODELING
COMPRESSION LOAD
A1
A3
ℓ
$\lambda = \frac{l}{k}$ : SLENDERNESS RATIO
*SMALLER λ LEADS TO LESS BUCKLING
$l$ : LENGTH
$k = \sqrt{\frac{I}{A}}$ :RADIUS OF GYRATION OF AREA
$I$ : MOMENT OF INERTIA OF AREA
$A$ : CROSS SECTIONAL AREA
λ FIG.12A > λ FIG.12B , λ FIG.12C
IN THIS EXAMPLE, SLENDERNESS RATIO IS REDUCED TO INCREASE BUCKLING LOAD IN FIG.12B AND FIG.12C WITH RIB, AS COMPARED WITH FIG.12A WITHOUT RIB

VALVE DEVICE FOR COMPRESSOR

RELATED APPLICATIONS

This is a U.S. national stage of International application No. PCT/JP2012/053042 filed on Feb. 10, 2012.

This application claims the priority of Japanese application no. 2011-050717 filed Mar. 8, 2011, the entire content of which is hereby incorporated by reference.

FIELD OF THE INVENTION

Technical Field

The present invention relates to a valve device opened and closed to draw or discharge a refrigerant in a compressor used in a refrigeration cycle air conditioner and the like.

BACKGROUND ART

In this type of compressor, as disclosed in, for example, Patent Document 1, a suction hole for drawing a refrigerant from a suction chamber into a cylinder bore and a discharge hole for discharging a compressed refrigerant from the cylinder bore into a discharge chamber are formed in a valve plate placed between a cylinder head and the cylinder bore, and a suction valve and a discharge valve of a reed valve structure for opening and closing the suction hole and the discharge hole are attached to the valve plate.

A valve seat is formed in an outer peripheral portion of each of the suction hole and the discharge hole, so as to protrude in a boss shape to a groove formed around the outside thereof.

CITATION LIST

Patent Document

Patent Document 1: Japanese Laid-Open Patent Application Publication No. H11-210626

SUMMARY OF THE INVENTION

Problems to be Solved by the Invention

Here, oil mixed into the refrigerant adheres between a valve body and a seat surface of the valve seat and causes the valve body to adhere to the seat surface, making valve opening difficult. In the case in which the radial width (hereafter simply referred to as "width") of the valve seat is large and the seat area is large, the valve body adheres to the seat surface with a large force. When, upon valve opening, a negative suction pressure or a discharge pressure from the cylinder bore increases and reaches the adhesion force (valve opening pressure) or more, the valve opens at once. Pressure pulsations (suction pulsations or discharge pulsations) occurring at this time cause an increase in noise and a decrease in compressor efficiency.

If the width of the valve body seat surface is reduced to make the seat area smaller in order to solve the abovementioned problem, before the noise and the efficiency decrease due to pressure pulsations are sufficiently suppressed, the impact upon seating the valve body on the valve seat causes damage, such as crushing, buckling, and fatigue, of the valve seat from a seat portion on the valve body distal side in which the impact is significant. Resulting lower sealability accelerates degradation in compressor performance.

In view of these conventional problems, the present invention has an object of providing a valve device for a compressor, the valve device being capable of preventing the adhesion of the valve body to the seat surface to suppress noise and maintain preferable compressor efficiency and also ensuring durability to prevent degradation in compressor performance.

Means for Solving the Problems

Therefore, the present invention provides a valve device having a reed valve structure, and the valve device includes: a valve plate in which a valve hole opened and closed to draw or discharge a refrigerant is formed; a valve seat formed in an outer peripheral portion of the valve hole in the valve plate so as to protrude in a boss shape to a groove formed around an outside thereof; and a valve body having a proximal end connected to the valve plate and a distal end allowed to freely come into and out of contact with a seat surface of the valve seat, in which the valve seat or a peripheral portion including the valve seat is shaped so that a portion corresponding to a distal side of the valve body is reinforced relative to a portion corresponding to a proximal side of the valve body.

Advantageous Effect of the Invention

In the valve device of the reed valve structure, the portion of the valve seat on which the distal side of the valve body is seated has, for example, a large amount of stroke upon valve opening and closing as compared with the portion on which the proximal side of the valve body is seated. Accordingly, due to the impact upon seating the valve body, a large compression load acts on the portion of the valve seat on which the distal side of the valve body is seated.

Hence, by employing such a shape that makes the portion of the valve seat on which the distal side of the valve body is seated, where a large compression load acts, stronger than the portion on which the proximal, side of the valve body is seated, where a relatively small compression load acts, in the valve seat, crushing, buckling, and fatigue are suppressed. Degradation in compressor performance caused by lower sealability can be suppressed in this way.

Moreover, this partial reinforcement structure enables the seat area to be reduced to such an extent that ensures a necessary strength, at least in the portion on which the distal side of the valve body is seated where a relatively small load acts. This reduces the adhesion force of the valve body to the seat surface and suppresses the occurrence of pressure pulsations upon valve opening, so that noise can be suppressed and preferable compressor efficiency can be maintained.

BRIEF DESCRIPTION OF THE DRAWINGS

FIG. 12 is a view for explaining a buckling and fatigue suppression effect of a valve device according to the present invention.

MODE FOR CARRYING OUT THE INVENTION

Hereunder, an embodiment of the present invention will be explained in detail, based on the attached drawings.

Figure 1:
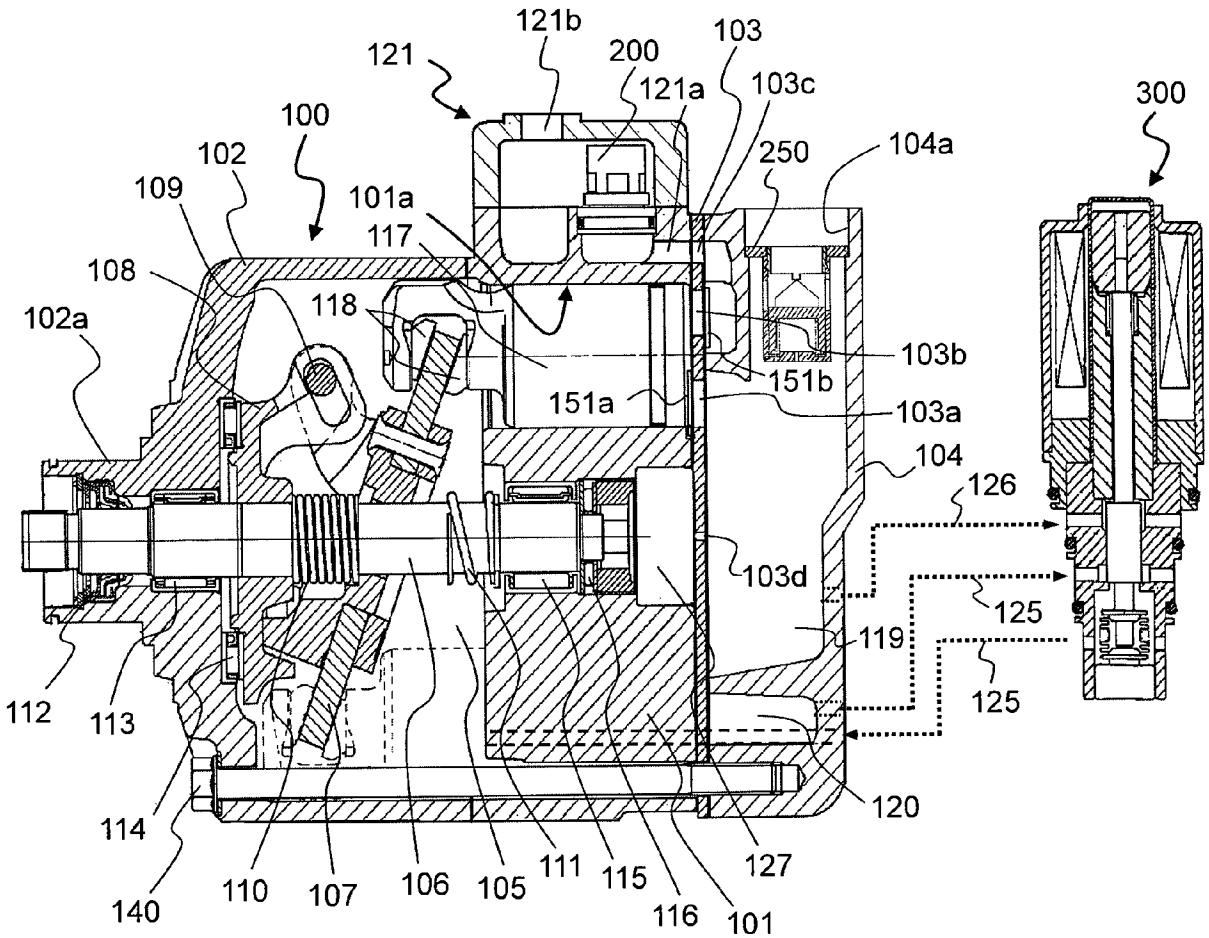
FIG. 1 is a longitudinal sectional view illustrating a variable capacity compressor including a valve device according to the present invention.

FIG. 1 illustrates a compressor in the embodiments. The compressor is a swash plate-type variable capacity reciprocating compressor 100 used in an air conditioning system of a vehicle.

The compressor 100 includes: a cylinder block 101; a front housing 102 connected to one end of the cylinder block 101; and a cylinder head 104 connected to the other end of the cylinder block 101 via a valve plate 103.

The cylinder block 101 and the front housing 102 define a crank chamber 105. A drive shaft 106 is provided so as to extend laterally across the a crank chamber 105, and the drive shaft 106 is rotatably supported via bearings 113, 115, and 116 in the radial and thrust directions with respect to the cylinder block 101 and the front housing 102.

The tip of the drive shaft 106 passes through a boss portion 102*a* of the front housing 102 and protrudes out of the front housing 102. Drive sources such as an engine and a motor of a vehicle are connected to the protruding tip via a power transmission device.

A shaft seal device 112 is provided between the drive shaft 106 and the boss portion 102*a*, to block the inside (the crank chamber 105) of the front housing 102 from outside.

In the crank chamber 105, a rotor 108 is fixed to the drive shaft 106, and a swash plate 107 is attached to the rotor 108 via a connection portion 109.

The drive shaft 106 passes through a through hole formed in a center portion of the swash plate 107. The swash plate 107 rotates together with the drive shaft 106, and is slidably and inclinably supported in the axial direction of the drive shaft 106. The rotor 108 is rotatably supported by a thrust bearing 114 disposed on the inner wall of the front end of the front housing 102.

A coil spring 110 for biasing the swash plate 107 in the direction in which the angle of inclination of the swash plate 107 decreases is disposed between the rotor 108 and the swash plate 107, and a coil spring 111 for biasing the swash plate 107 in the direction in which the angle of inclination of the swash plate 107 increases is disposed between the cylinder block 101 and the swash plate 107.

In the cylinder block 101, a plurality of cylinder bores 101*a* are formed so as to surround the drive shaft 106. In each cylinder bore 101*a*, a piston 117 is housed in a state of being allowed to reciprocate in the axial direction of the drive shaft 106. Each piston 117 engages with an outer peripheral portion of the swash plate 107 via a shoe 118 and, when the swash plate 107 rotates together with the drive shaft 106, each piston 117 reciprocates in the cylinder bore 101*a*.

In the cylinder head 104, a suction chamber 119 is disposed on an extension of the axis of the drive shaft 106, and a discharge chamber 120 is disposed to annularly surround the suction chamber 119. The suction chamber 119 communicates with the cylinder bore 101*a* via a valve hole 103*a* formed in the valve plate 103 and a valve body 151*a* of a suction valve. The discharge chamber 120 communicates with the cylinder bore 101*a* via a valve body 151*b* of a discharge valve and a valve hole 103*b* formed in the valve plate 103.

The front housing 102, the cylinder block 101, the valve plate 103, and the cylinder head 104 are fastened together by a plurality of through bolts 140 via gaskets not illustrated, to form a compressor housing.

A muffler 121 is provided outside the cylinder block 101. In the muffler 121, a communication path 121*a* communicating with the discharge chamber 120 is formed to overlap with a communication path 103*c* formed in the valve plate, and a check valve 200 is arranged. The check valve 200 opens only when the pressure in the discharge chamber 120 on the upstream side is higher than the pressure on the downstream side by a predetermined value or more, to cause a refrigerant flowing in from the discharge chamber 120 via the communication paths 103*c* and 121*a* to be discharged from a discharge port 121*b*.

In the cylinder head 104, a suction port 104*a* connected to a suction-side refrigerant circuit (evaporator) of the air conditioning system of the vehicle is formed, and an opening adjustment valve 250 is placed near the downstream side of the suction port 104*a*. The flow-controlled refrigerant is drawn into the suction chamber 119 from the suction-side refrigerant circuit (evaporator) via the suction port 104*a* and the opening adjustment valve 250.

A capacity control valve 300 is attached to the cylinder head 104.

The capacity control valve 300 adjusts an opening of a communication path 125 communicating between the discharge chamber 120 and the crank chamber 105, to control the inflow amount of discharge refrigerant that flows into the crank chamber 105.

The refrigerant in the crank chamber 105 passes through the gap between the drive shaft 106 and the bearings 115 and 116, and flows into the suction chamber 119 via a space 127 formed in the cylinder block 101 and an orifice 103*d* formed in the valve plate 103.

Thus, the capacity control valve 300 adjusts the inflow amount of discharge refrigerant that flows into the crank chamber 105 and changes the pressure in the crank chamber 105, thereby changing the angle of inclination of the swash plate 107, i.e. the amount of stroke of the piston 117. This enables the discharge capacity of the compressor 100 to be controlled.

Here, the capacity control valve 300 adjusts the amount of current to an internal solenoid based on an external signal, to control the discharge capacity of the compressor 100 so that the pressure of the suction chamber 119 introduced into a pressure sensitive chamber in the capacity control valve 300 via a communication path 126 is at a predetermined value. The capacity control valve 300 also interrupts the current to the internal solenoid, to forcibly open the communication path 125 and control the discharge capacity of the compressor 100 to the minimum.

A valve device including the valve body 151 a and the valve hole 103*a* of the suction valve, and the valve body 151*b* and the valve hole 103*b* of the discharge valve is described in detail below.

First, a basic structure (conventional structure) of this type of valve device and the influence exerted on the valve seat by the compression load that acts on the seat surface of the valve seat upon opening and closing of the valve body are described.

Figure 10A:
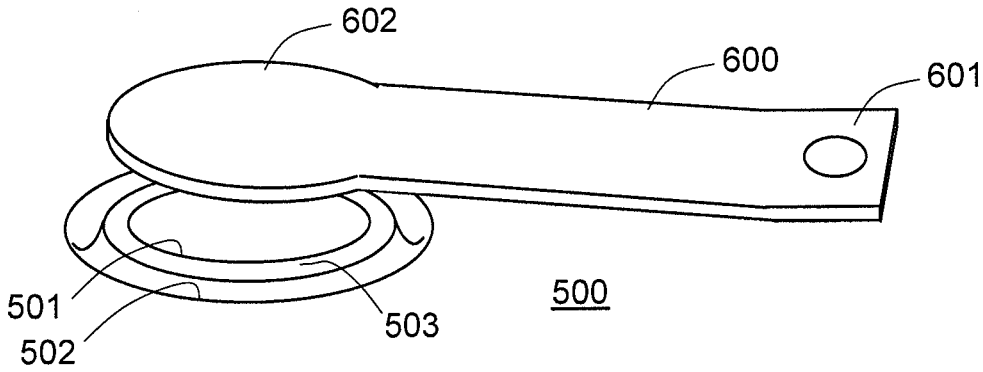
FIG. 10 is a view for explaining a problem with a conventional valve device.

As illustrated in FIG. 10A, in an outer peripheral portion of a valve hole 501 formed in a valve plate 500, a valve seat 503 is formed so as to protrude in a boss shape to a groove 502 formed around the outside thereof. By providing the groove 502 to form the boss-shaped valve seat 503, it is possible to accurately form a seat surface for a valve body 600. In addition, by pressing the valve plate 500, it is possible to easily form the valve seat 503 simultaneously with the groove 502.

The valve body 600 configured by a long thin reed valve has a proximal end 601 fixed to the valve plate, and a circular distal end 602 coming into and out of contact with the top surface (seat surface) of the valve seat 503 to close and open the valve hole 501.

As mentioned above, the portion of the valve seat 503 on which the distal side of the valve body 600 is seated has, for example, a large amount of stroke upon valve opening and closing as compared with the portion on which the proximal side of the valve body 600 is seated, so that a large compression load acts on the portion of the valve seat 503 on which the distal side of the valve body 600 is seated due to the impact upon seating the valve body 600.

If the radial width of the valve seat 503 is reduced to reduce the adhesion force of the valve body 600 to the valve seat 503, before the noise and the efficiency decrease due to pressure pulsations are sufficiently suppressed, the above-mentioned compression load causes damage from the portion on which the distal side of the valve body 600 is seated, due to insufficient strength of the portion.

Figure 10B:
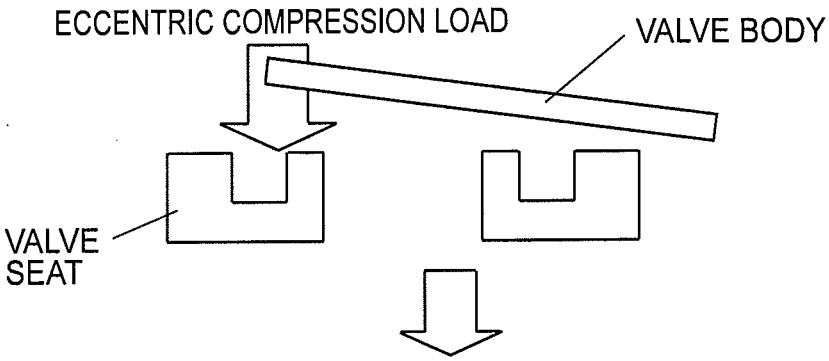
Figure 10C:
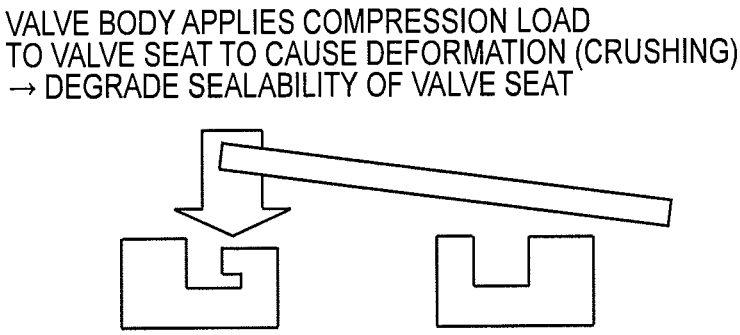

As illustrated in FIGS. 10B and 10C, One form of damage is "crushing" caused in a manner that, when a large compression load acts on the seat surface due to the impact upon seating on the valve seat, a large surface pressure (pressure per unit area) is generated and induces a plastic deformation.

Figure 10D:
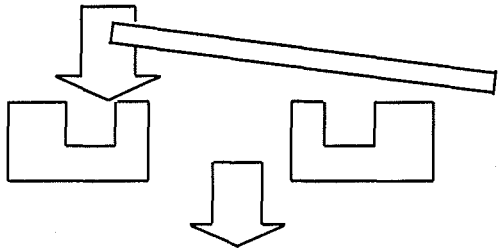
Figure 10E:
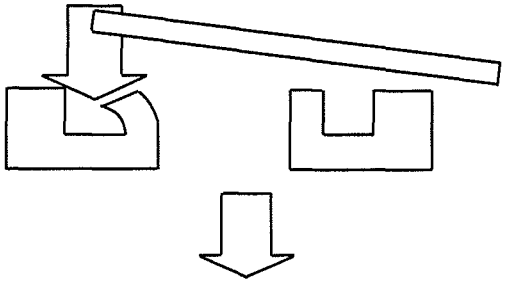
Figure 10F:
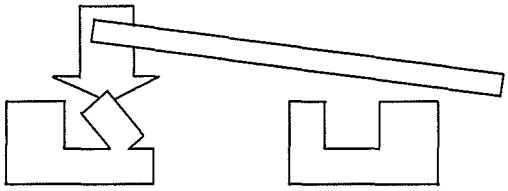

As illustrated in FIGS. 10D, 10E, and 10F, another form of damage is "buckling" caused in a manner that when a compression load acts on the seat surface of the valve seat, a bending moment is generated and reaches a buckling load. There is also "fatigue" caused by repeated generation of the bending moment even in the case in which the buckling load is not reached.

Thus, in the following embodiments, the valve seat or the peripheral portion including the valve seat is shaped so that the portion corresponding to the distal side of the valve body is reinforced more than the portion corresponding to the proximal side of the valve body, in order to prevent damage such as "crushing", "buckling", and "fatigue" mentioned above.

Figure 2A:
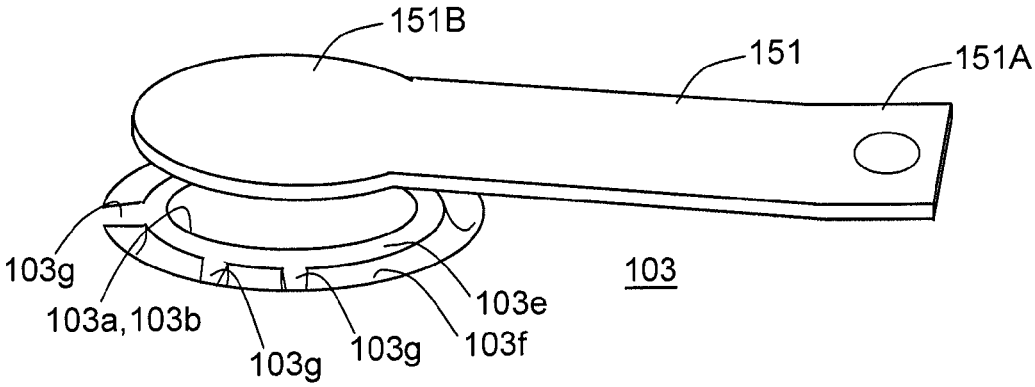
FIG. 2 is a perspective view and a plan view illustrating a valve device according to a first embodiment.
Figure 2B:
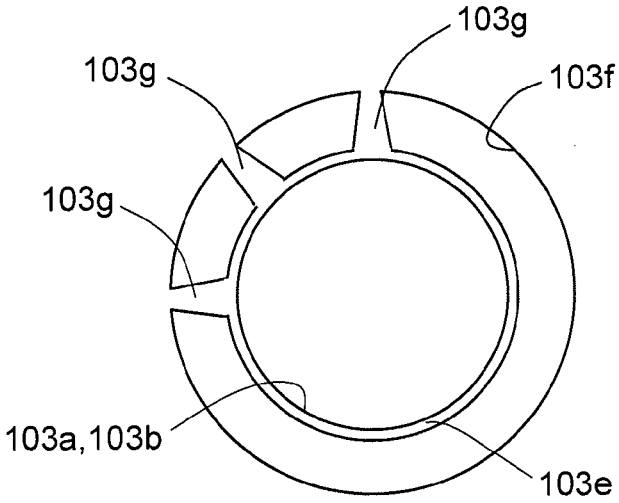

In an embodiment illustrated in FIGS. 2A and 2B, a plurality of (three in FIGS. 2A and 2B) ribs 103*g* extend radially from the peripheral wall of the portion of a valve seat 103*e* on which the distal side of a valve body 151 is seated, to the outer peripheral wall of a groove 103*f*.

Figure 3:
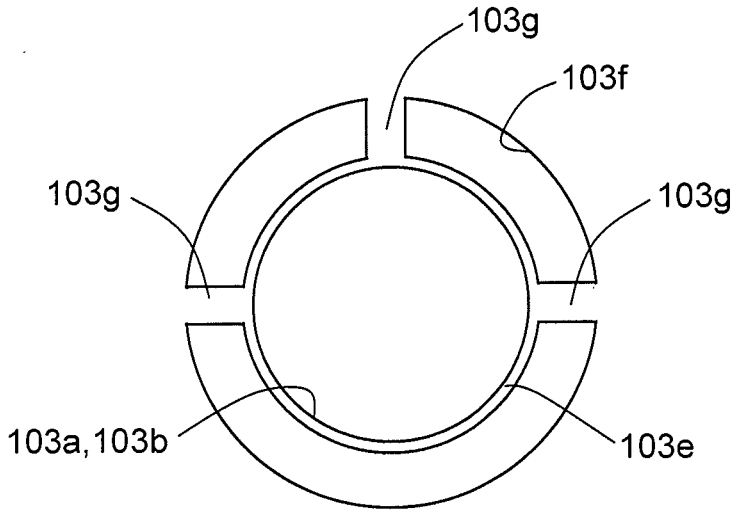
FIG. 3 is a plan view illustrating a valve device according to a second embodiment.
Figure 4:
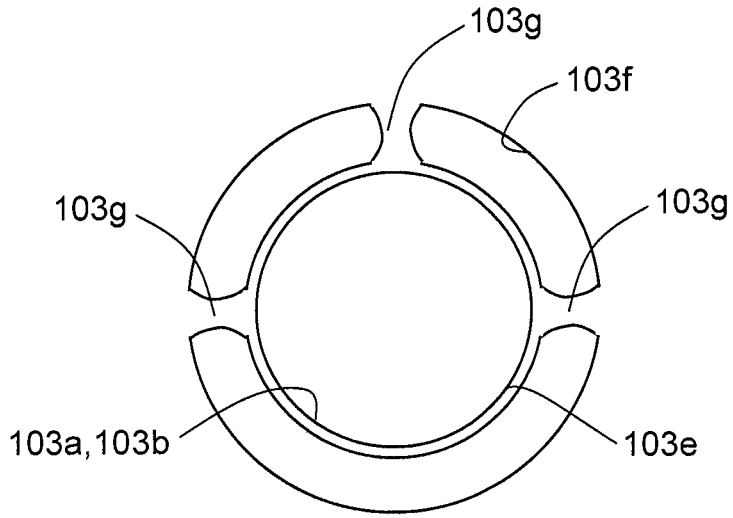
FIG. 4 is a plan view illustrating a valve device according to a third embodiment.

The shape of the rib 103*g* may be any shape, such as a radially outwardly tapered shape as illustrated in FIGS. 2A and 2B, a shape with a uniform radial width as illustrated in FIG. 3, or a shape narrower in a radial center portion as illustrated in FIG. 4.

The height (the height from the bottom of the groove 103*f*, the same applies hereafter) of the rib 103*g* is set to be equal to or slightly less than the height of the seat surface (which is the valve plate surface) of the valve seat 103*e*.

The following describes the effects of these embodiments of the valve device.

The case in which the height of the rib 103*g* is set to be equal to the height of the seat surface (which is the valve plate surface) of the valve seat 103*e* is described first.

Figure 11:
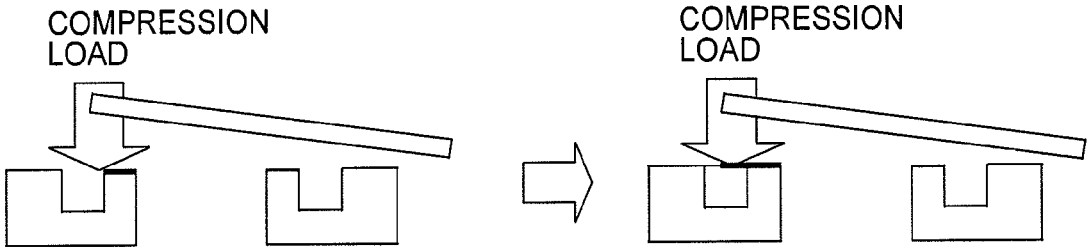
FIG. 11 is a view for explaining a crushing suppression effect of a valve device according to the present invention.

In this case, the peripheral portion of the valve body 151 (151*a* or 151*b*) on the distal side is seated not only on the seat surface of the valve seat 103*e* but also on the flat top surface of each rib 103*g*. This increases the area of the seat surface including the portions in which these ribs 103*g* are formed and their nearby valve seat 103*e*. Therefore, even when a large compression load is applied due to the impact upon seating the distal side of the valve body 151, crushing can be effectively suppressed as a result of a reduction in surface pressure (see an explanatory view of FIG. 11).

In addition, the cross sectional area (the sectional area in the direction parallel to the valve plate, the same applies hereafter) of the portion in which the rib 103*g* and the valve seat 103*e* are integrated is increased to reduce the slenderness ratio λ, thus increasing the buckling load in the portion. Therefore, even when a large compression load is applied due to the impact upon seating the distal side of the valve body 151, buckling can be effectively suppressed and also fatigue due to a repetitive compression load can be effectively suppressed (see an explanatory view of FIG. 12B).

By suppressing the damage of the valve seat 103*e* such as crushing, buckling, and fatigue in this way, degradation in compressor performance caused by lower sealability can be prevented.

As a result of enhancing the effect of suppressing crushing, buckling, and fatigue by the partial reinforcement of the valve seat 103*e*, the width of the valve seat 103*e* on the whole circumference can be reduced to make the total area of the seat surface smaller. This reduces the adhesion force of the valve body 151 due to oil inserted between the valve body 151 and the seat surface of the valve seat 103*e* and sufficiently suppresses the occurrence of pressure pulsations upon valve opening, so that noise can be suppressed and preferable compressor efficiency can be maintained.

In FIGS. 2A and 2B, the rib 103*g* is disposed at each of: one position in the portion of the valve seat 103*e* on which the distal end of the valve body 151 is seated; and two positions in the portion on the left side of the foregoing position, as illustrated in FIG. 2B.

Figure 13:
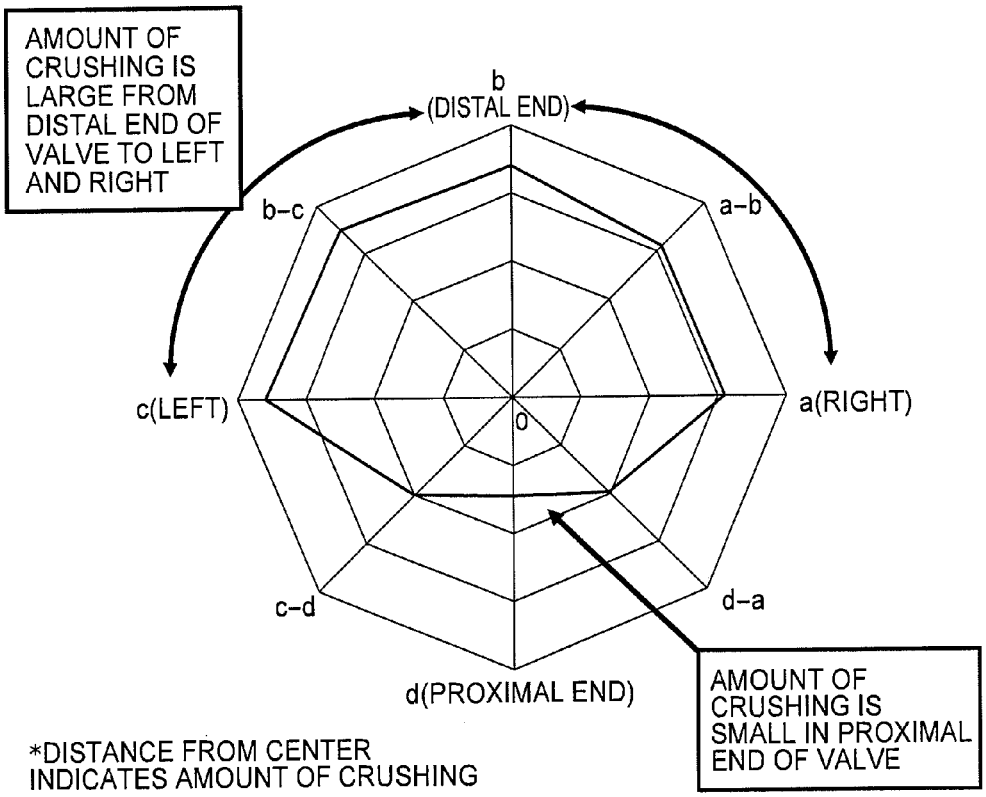
FIG. 13 is a view illustrating a distribution of crushing amounts of a valve seat in a conventional valve device.

The abovementioned arrangement of the ribs 103*g* is achieved in response to the result of measuring the amount of crushing of an annular valve seat in the case in which no rib is provided as illustrated in FIG. 13. The amount of crushing of the portion on which the distal side of the valve body is seated is larger on the left side of the direction from the proximal end to the distal end of the valve body in FIG. 13, suggesting that a large compression load acts on the left side. For example, in the case in which the center axis of the cylinder bore 101*a* is located on the left side of the direction from the proximal end 151A to the distal end 151B of the valve body 151 in FIG. 13, typically the suction force from the cylinder bore is larger on the left side and causes a large compression load to act on the seat surface of the valve seat on the left side.

Meanwhile, as illustrated in FIG. 13, the amount of crushing is especially large within the range of 90 degrees on each side of the direction from the center of the valve seat 103*e* to the distal end of the valve body, as compared with the range exceeding 90 degrees on each side. It is therefore clear that the rib 103*g* is preferably disposed within the range of 90 degrees on each side. Accordingly, in FIGS. 3 and 4, the rib 103*g* is disposed at each of: one position in the direction from the center of the valve seat 103*e* to the distal end of the valve body 151; and two positions of 90 degrees on both sides of the direction to the distal end of the valve body 151. Note that, though the positions of 90 degrees on both sides of the direction to the distal end of the valve body 151 are midway between the portion of the valve seat 103*e* on the distal side of the valve body 151 and the portion of the valve seat 103*e* on the proximal side of the valve body 151, the rib 103*g* at the position in the direction to the distal end of the valve body 151 and the ribs 103*g* at the positions of 90 degrees on both sides are combined, so that the valve seat 103*e* or the peripheral portion including the valve seat 103*e* on the distal side of the valve body 151 is reinforced more than on the proximal side of the valve body 151.

Three ribs 103*g* are provided in the embodiments described above; however, two ribs or four or more ribs may be provided. Moreover, the ribs 103*g* adjacent in the circumferential direction may be equally spaced or unequally spaced.

Furthermore, the rib 103*g* may be provided only at one position. On the basis of the result indicated in FIG. 13, one rib 103*g* is preferably disposed in the range of about 45 degrees on the side where the amount of crushing is larger (the left side in FIG. 13), in the direction from the center of the valve seat 103*e* to the distal end of the valve body.

The above-mentioned rib arrangement positions and number of ribs arranged also apply to the following embodiments.

The case in which the height of the rib 103*g* is set to be slightly less than the height of the seat surface (which is the valve plate surface) of the valve seat 103*e* in the embodiments illustrated in FIGS. 2 to 4 is described below.

In this case, the long thin portion of the valve seat 103*e* that is provided with the rib 103*g* and is higher than the top surface of the rib 103*g* is made sufficiently small to reduce the slenderness ratio λ, thus increasing the buckling load. Therefore, even when a large compression load is applied due to the impact upon seating the distal side of the valve body 151, buckling can be effectively suppressed and also fatigue due to a repetitive compression load can be effectively suppressed (see an explanatory view of FIG. 12C). Degradation in compressor performance caused by lower sealability can be prevented in this way.

Moreover, since the valve body 151 is not seated on the rib 103*g*, the total area of the seated valve body 151 is reduced to reduce the adhesion force. This further enhances the noise suppression effect and the compressor efficiency maintenance effect.

In the case in which the valve seat on the proximal side of the valve body is reinforced in the same way as the valve seat on the distal side of the valve body by providing a rib and the like, the seat portion on the distal side that is subject to a large compression load is relatively low in durability strength as compared with the seat portion on the proximal side, and thus, it is easy to damage from this weak portion. Hence, in the present invention, the seat portion on the distal side that is subject to a large compression load is reinforced more than the seat portion on the proximal side to thereby make the durability strength of the entire valve seat uniform, so that crushing, buckling, and fatigue can be effectively suppressed.

Figure 5:
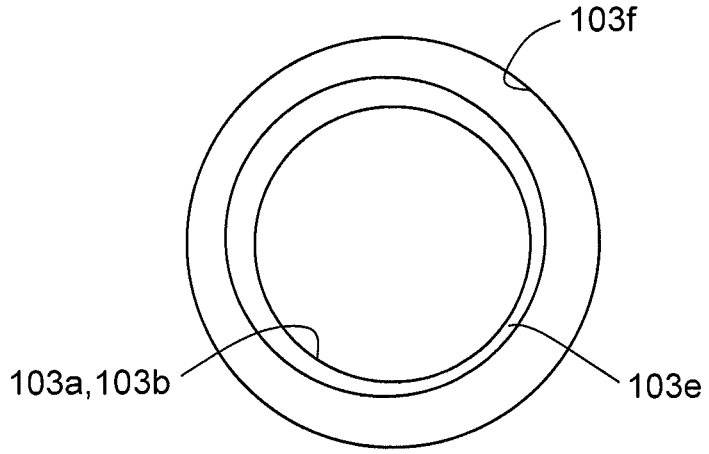
FIG. 5 is a plan view illustrating a valve device according to a fourth embodiment.

FIG. 5 illustrates an embodiment in which with respect to the center axis of the valve hole 103*a* or 103*b* forming the inner peripheral surface of the valve seat 103*e*, the center axis of the outer peripheral surface of the valve seat 103*e* is offset toward the distal side of the valve body 151, the valve seat 103*e* is formed so that the radial thickness of the portion on which the distal side of the valve body 151 is seated is greater than the radial thickness of the portion on which the proximal side of the valve body 151 is seated. In this embodiment, based on the result in FIG. 13, the center axis of the outer peripheral surface of the valve seat 103*e* is offset in the direction of about 45 degrees on the side where the amount of crushing is large (the left side in FIG. 13) in the direction from the center of the valve seat to the distal end of the valve body.

In this embodiment, by increasing the seat area of the portion of the valve seat 103*e* on which the distal side of the valve body 151 is seated, the surface pressure is reduced. Thus, crushing can be suppressed. In addition, the cross sectional area of the same portion is increased, so that buckling and fatigue can be suppressed. Degradation in compressor performance can be prevented in this way.

Furthermore, the width of the portion of the valve seat 103*e* on which the proximal side of the valve body 151 is seated is reduced to make the total area of the seated valve body 151 smaller. This reduces the adhesion force, so that noise can be suppressed and preferable compressor efficiency can be maintained.

Figure 6A:
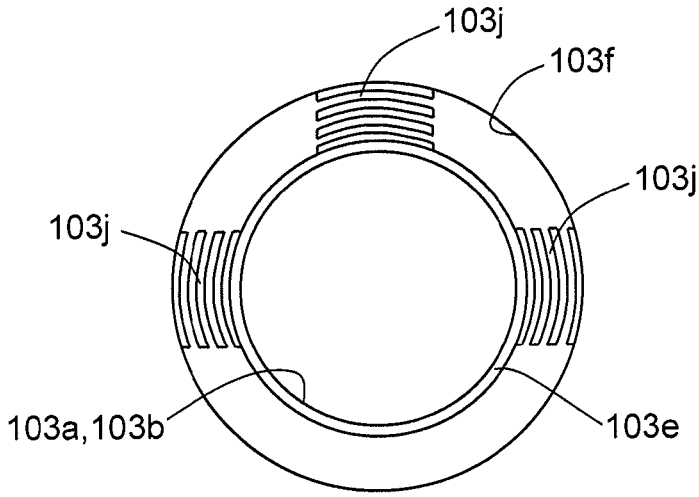
FIG. 6 is a plan view and a longitudinal sectional view illustrating a valve device according to a fifth embodiment.
Figure 6B:
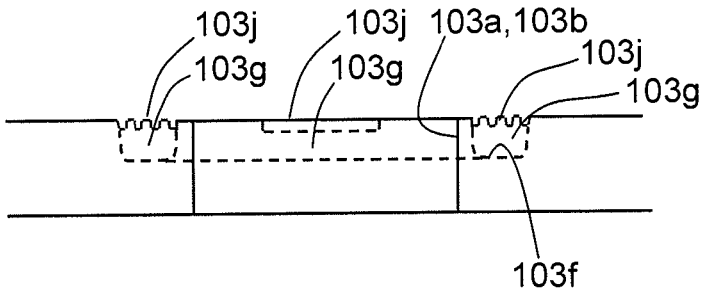

FIG. 6 illustrates an embodiment in which a plurality of ribs 103*g* extend radially from the peripheral wall of the portion of the valve seat 103*e* on which the distal side of the valve body 151 is seated to the outer peripheral wall of the groove 103*f*, and also the top surface of the rib 103*g* has a plurality of parallel ridges 103*j* along the circumferential direction.

The height of the ridge 103*j* of the rib 103*g* is set to be equal to the height of the seat surface (which is the valve plate surface) of the valve seat, as illustrated in FIG. 6.

According to this structure, the valve body 151 is also seated on each ridge 103*j* of the rib 103*g*, so that the surface pressure is reduced. Thus, crushing can be suppressed.

Moreover, the rib 103*g* formed integrally with the valve seat 103*e* increases the cross sectional area of the portion to reduce the slenderness ratio λ, so that buckling and fatigue can be suppressed.

Degradation in compressor performance can be prevented in this way.

Especially in this embodiment, the buckling and fatigue suppression effects can be further enhanced by ensuring a sufficiently large cross sectional area of the rib 103*g*, while limiting the seat area increase to a minimum necessary level effective for crushing suppression by providing the ridge 103*j* on the top surface of the rib 103*g* instead of making the top surface flat.

Figure 7:
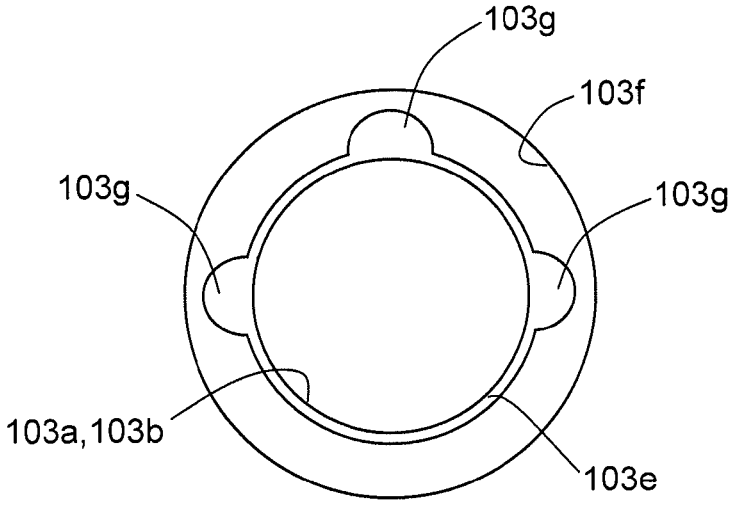
FIG. 7 is a plan view illustrating a valve device according to a sixth embodiment.

FIG. 7 illustrates an embodiment in which the radial tip of each rib 103*g* extending radially from the peripheral wall of the portion of the valve seat 103*e* on which the distal side of the valve body 151 is seated does not reach the outer peripheral wall of the groove 103*f*.

In this case, the rib 103*g* has the same effects as in the embodiments illustrated in FIGS. 2 to 4, for each of the embodiments that the top surface of the rib 103*g* is equal in height to the seat surface (which is the valve plate surface) of the valve seat and that the top surface of the rib 103*g* is slightly less in height than the seat surface of the valve seat. In the equal height embodiment, crushing, buckling, and fatigue are suppressed. In the slightly less height embodiment, buckling and fatigue are suppressed to prevent degradation in compressor performance, and also the adhesion force is reduced to suppress noise and maintain preferable compressor efficiency.

Figure 8:
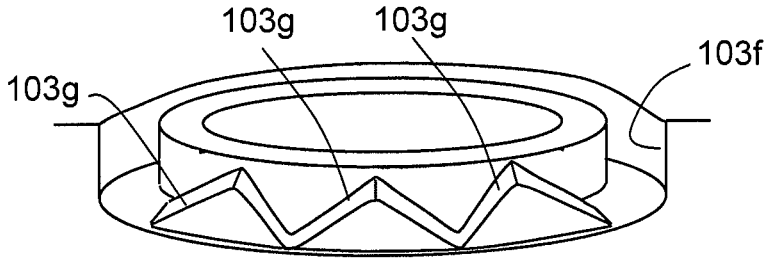
FIG. 8 is a partial perspective and broken view illustrating a valve device according to a seventh embodiment.

FIG. 8 illustrates an embodiment in which each tapered rib 103*g* tapered from the bottom surface of the groove 103*f* toward the top in the portion of the valve seat 103*e* on which the distal side of the valve body 151 is seated is disposed.

In this embodiment, if the top of the rib 103*g* is equal in height to the seat surface of the valve seat 103*e*, the compression load from the valve body 151 is supported by the valve seat 103*e* and the rib 103*g*, so that crushing of the valve seat

103*e* can be suppressed. In such a case, similar to the embodiment illustrated in FIG. 6, crushing can be suppressed while limiting the seat area increase to a minimum necessary level effective for crushing suppression.

Moreover, by providing the rib 103*g* integrally with the valve seat 103*e*, the slenderness ratio λ of the portion where the rib 103*g* is provided is reduced to suppress buckling and fatigue.

Degradation in compressor performance can be prevented in this way.

Figure 9:
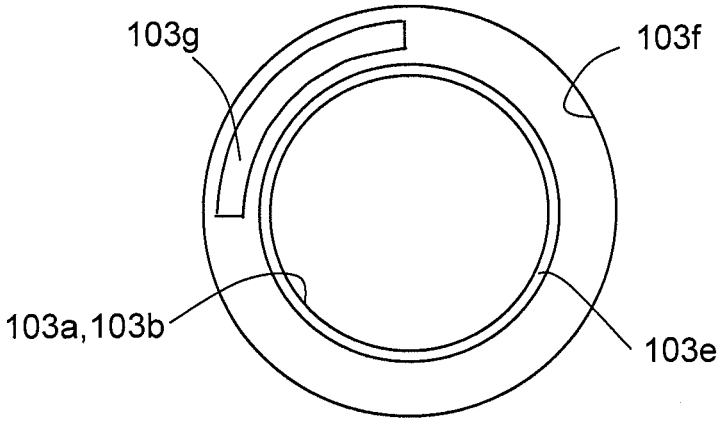
FIG. 9 is a plan view illustrating a valve device according to an eighth embodiment.

FIG. 9 illustrates an embodiment in which a rib 103*g* raised from the bottom surface of the groove 103*f* in the portion of the valve seat 103*e* on which the distal side of the valve body 151 is seated is formed separately from the valve seat 103*e*. The height of the rib 103*g* is assumed to be equal to the height of the seat surface (which is the valve plate surface) of the valve seat 103*e*.

In the case in which the rib 103*g* is formed separately from the valve seat 103*e* as in this embodiment, the valve body 151 is also seated on the rib 103*g* to reduce the surface pressure of the valve seat 103*e*, so that crushing of the valve seat 103*e* can be suppressed.

In this embodiment, the valve seat 103*e* itself is not directly reinforced, as the rib 103*g* is separate from the valve seat 103*e*. However, the reduction in surface pressure contributes to a smaller compression load on the portion of the valve seat 103*e* on which the distal side of the valve body 151 is seated. Thus, bending moment generated in the valve seat 103*e* is reduced, so that buckling and fatigue can be suppressed as well.

Degradation in compressor performance can be prevented in this way.

Furthermore, the partial rib 103*g* is formed to reduce the total area of the valve body seat surface. Thus, the adhesion force is reduced, so that noise can be suppressed and preferable compressor efficiency can be maintained.

Though the abovementioned embodiments are preferably applied to both the suction valve device and the discharge valve device, it is obvious that certain advantageous effects can be achieved even in the case in which the abovementioned embodiments are applied to only one of the suction valve device and the discharge valve device.

Though the abovementioned embodiments are applied to a piston reciprocating compressor, the present invention is applicable to all types of compressors, such as a scroll compressor, that use a reed valve opened and closed to draw or discharge a refrigerant.

DESCRIPTION OF REFERENCE NUMERALS

100 compressor
101 cylinder block
101*a* cylinder bore
103 valve plate
103*a* valve hole (suction side)
103*b* valve hole (discharge side)
103*e* valve seat
103*f* groove
103*g* rib
104 cylinder head
151 valve body
151*a* valve body of suction valve
151*b* valve body of discharge valve
151A proximal end
151B distal end

The invention claimed is:

1. A valve device for a compressor, which has a reed valve structure, comprising:

a valve plate in which a valve hole opened and closed to draw or discharge a refrigerant is formed;

a valve seat formed in an annular shape in an outer peripheral portion of the valve hole in the valve plate, wherein a groove is formed around an outside of the valve seat; and a valve body having a proximal end connected to the valve plate and a distal end allowed to freely come into and out of contact with a seat surface of the valve seat, wherein at least one rib extends radially outwardly from the portion of the valve seat corresponding to the distal side of the valve body, and wherein a height of the at least one rib from a bottom of the groove is less than a height of the seat surface of the valve seat from the bottom of the groove.

2. The valve device for the compressor according to claim 1, wherein the at least one rib extends from an outer peripheral wall of the valve seat to an outer peripheral wall of the groove.

3. The valve device for the compressor according to claim 1, wherein the at least one rib extends from an outer peripheral wall of the valve seat to a point between the outer peripheral wall of the valve seat and an outer peripheral wall of the groove.

4. The valve device for the compressor according to claim 1, wherein the at least one rib is tapered from the bottom of the groove toward an opening of the groove.

5. The valve device for the compressor according to claim 1 wherein the at least one rib is provided in a center angle range of 90 degrees on each side of a direction from a center of the valve hole to the distal end of the valve body.

* * * * *